US006345752B1

(12) United States Patent
Chapman

(10) Patent No.: US 6,345,752 B1
(45) Date of Patent: Feb. 12, 2002

(54) BELT PEN HOLDER

(76) Inventor: Leonard T. Chapman, 12950 Raymer St., North Hollywood, CA (US) 91605

( * ) Notice: Subject to any disclaimer, the term of this patent is extended or adjusted under 35 U.S.C. 154(b) by 0 days.

(21) Appl. No.: 09/559,369

(22) Filed: Apr. 24, 2000

(51) Int. Cl.[7] ..... A45F 5/00

(52) U.S. Cl. ..... 224/674; 224/676; 224/236; 224/240; 24/11 CT

(58) Field of Search ..... 224/191, 603, 224/604, 605, 647, 674, 676, 587, 232, 236, 240; 24/11 CT, 11 CC, 11 HC

(56) References Cited

U.S. PATENT DOCUMENTS 855,098 A 5/1907 Cutts
1,445,528 A * 2/1923 Marsh
1,468,991 A 9/1923 Butner
1,651,921 A * 12/1927 Felz
1,895,074 A * 1/1933 Hagerstrom
2,156,373 A * 5/1939 Craighead
2,714,479 A 8/1955 Zeitzew
D288,624 S * 3/1987 Hoard
4,756,458 A * 7/1988 Clifton
4,998,653 A * 3/1991 LaBelle ..... 224/240 X
5,009,346 A * 4/1991 Butler
5,511,704 A 4/1996 Linderer
5,526,924 A 6/1996 Klutznick
5,636,775 A * 6/1997 Kartsotis et al. ..... 224/236 X
5,680,026 A 10/1997 Lueschen
5,718,023 A 2/1998 Billish
6,182,878 B1 * 2/2001 Racca

* cited by examiner

*Primary Examiner*—Gregory M. Vidovich
(74) *Attorney, Agent, or Firm*—Lyon & Lyon LLP

(57) ABSTRACT

A holder for securely holding pens, pencils and other writing instruments, attaches to a belt or waistband horizontally. The holder comprises a front part and a back part attached to each other to form a pocket. The back part includes a flap which can be secured to the front part to close or cover the pocket.

13 Claims, 1 Drawing Sheet

BELT PEN HOLDER

BACKGROUND OF THE INVENTION

1. Field of the Invention

The present invention relates generally to pen holders that can be attached to a belt or waist band.

2. Background

Pens, pencils and other writing instruments, generically referred hereinafter as pens, are usually carried in shirt pockets or pencil boxes. However, often people do not wear pocketed shirts or do not wish to carry a box. One of the solutions to the situation is attaching a pen to an article of apparel like a belt or waist band.

Billish, U.S. Pat. No. 5,718,023, discloses a pen holder with a clip and at least one elastic sheath which is adapted to receive a pen. The holder can be clasped over the edge of a belt such that the long dimension of the holder's body and the pen inside are parallel to the long dimension of the belt. However, if the pen is significantly longer than the sheath holding it, one or both ends of the pen will protrude beyond the holder's borders. Depending on the position of the holder on the belt, a protruding pen may be an inconvenience to the wearer and to others in a number of situations, including sitting in a chair or moving in a crowded place. Also, if the Billish holder houses a pencil, and since the sheath covers only a portion of the pencil, the pencil's front element can easily be damaged through incautious movement of the wearer.

Therefore, there is a need for a pen holder that completely encloses the pen, thus eliminating the inconvenience of having the pen protruding outside of the holder and providing a better security for the pen itself.

SUMMARY OF THE INVENTION

The present invention is generally directed to belt pen holders.

In a separate aspect of the present invention, a pen holder comprises a pocket with a flap. The pocket receives a pen and is closed by the flap. Conventional fasteners, including Velcro hook and loop fasteners, buttons or snaps, are provided to close the holder. Being securely enclosed inside the holder, the pen's front element is protected, yet the pen is still immediately accessible.

Accordingly, it is an object of the invention to provide a more convenient and secure belt pen holder.

This and further objects and advantages will be apparent to those skilled in the art in connection with the drawings and the detailed description of the preferred embodiments set forth below.

BRIEF DESCRIPTION OF THE DRAWINGS

One or more preferred forms of the invention are described herein with reference to the accompanying drawings.

DETAILED DESCRIPTION OF THE PREFERRED EMBODIMENTS

Figure 1:
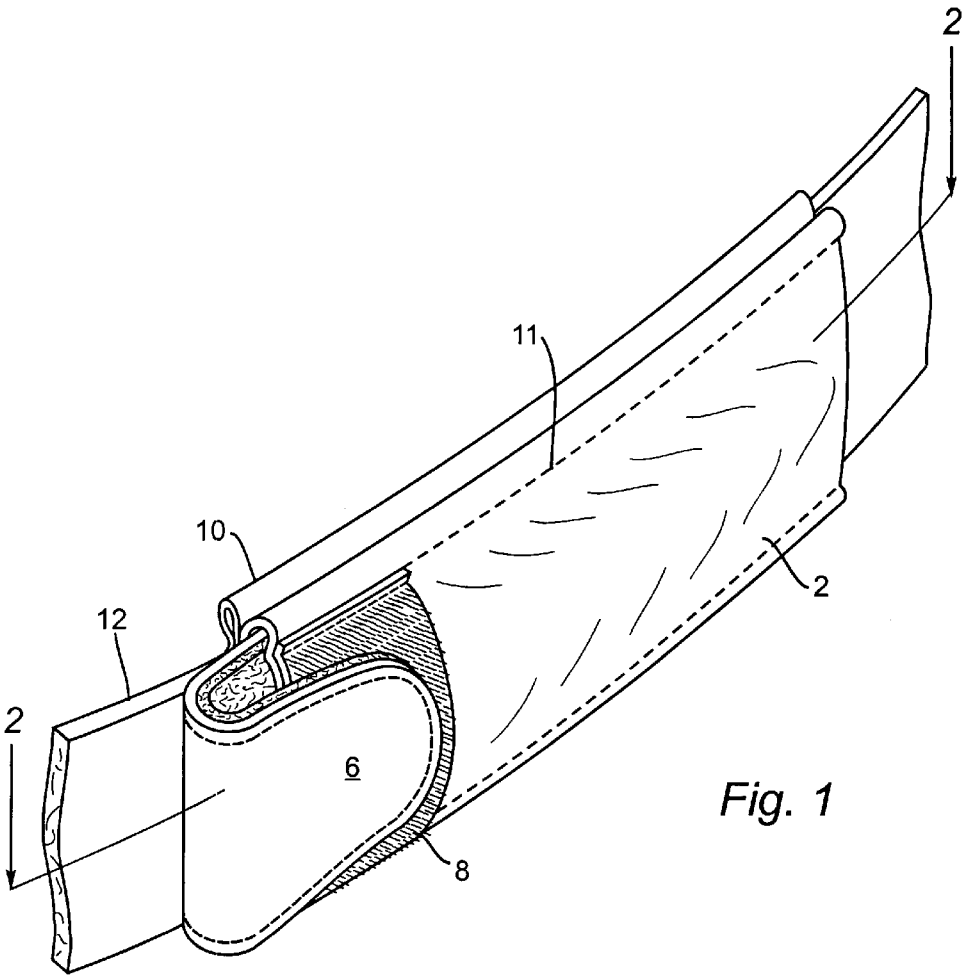
FIG. 1 is a perspective view of the present pen holder.
Figure 2:
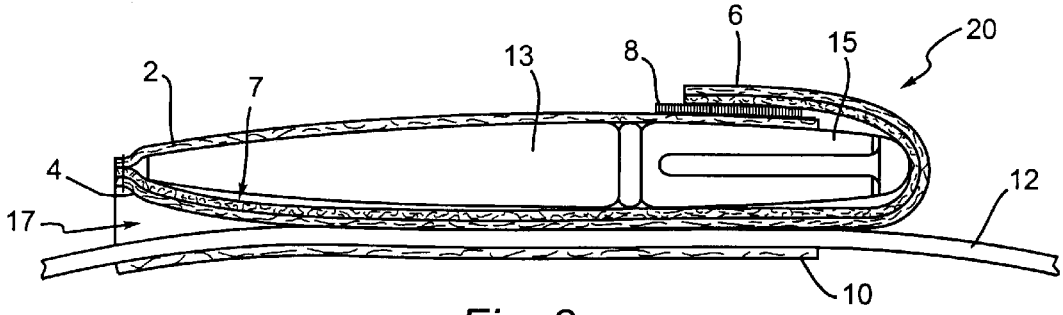
FIG. 2 is a sectional view of the pen holder taken along lines 2—2 of FIG. 1.
Figure 3:
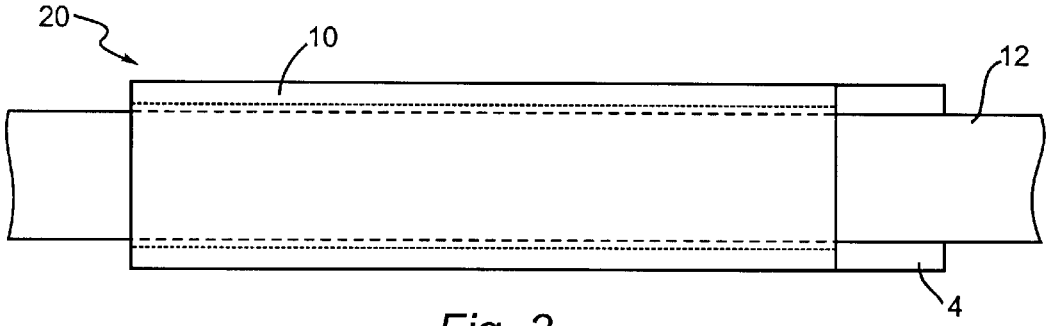
FIG. 3 is a back view of the pen holder.

Turning now in detail to the drawings, as shown on FIGS. 1–3, a pen holder 20 has a front part or section 2 and a back part or section 4. The front and back parts are stitched or glued together to form a pen pocket 7. The back part 4 is longer than the front part 2 such that it forms a flap 6. The flap 6 has a fastener 8. As is clear from the drawings, the fastener of the illustrated embodiment of the holder is a Velcro hook and loop fastener. The flap 6 folds and attaches to the front part 2 such that it covers the pocket created by the front and back parts. The flap can be quickly opened to remove and use the pen. The flap also prevents the pen 13 from inadvertently falling out. The flap may also be dimensioned to help hold the pen cap 15 onto the pen 13. If the pen 13 leaks ink, the ink is confined within the holder. Staining of the user's clothing is prevented.

A loop section 10 together with the back part 4 forms a continuous sleeve. The holder is inserted onto a belt 12 by pulling the belt 12 through the sleeve. The holder is preferably made from a flexible material such as leather or soft plastic. The holder on a belt conforms to the curvature of the wearer's body, while a relatively inflexible pen inside the holder is tangent to the body. This reduces stress on the wearer and on the holder.

The loop section 10 is preferably attached to the back part by stitches 11. The stitches 11 may also be used to attach the loop section onto the back part 4.

The loop section 10 and back part 4 form a loop opening 17 between them. The loop opening 17 is preferably just wide enough to accept the belt 12. The ratio of the length to the width of the pen holder is preferably in the range of 2–5.

The holder can come in various widths, thus conforming to belts of various widths. Preferably, as shown in FIG. 1, the holder is no wider than the belt (except for the material thickness of the loop section 10 needed to go around the upper and lower edges of the belt). This "low profile" allows the holder 20 to avoid interfering with body movements. The length of the holder can be approximately between four and six inches to hold pens of different sizes. Further, the loop section 10 need not be continuous. It may, for example, have one or more slots attached to the back part of the holder, perpendicular to the long dimension of the belt. As the holder is flexible and has no rigid surfaces, it is comfortable to use and wear. As the flap 6 folds over and can attach anywhere along the length of the Velcro hook and loop fasteners 8, pens of varying length can be accommodated within the holder. For wider embodiments, the holder may hold two writing implements, with or without a dividing surface between them.

Thus, a novel belt pen holder has been shown and described. Various changes can of course be made without departing from the spirit and scope of the invention. The invention, therefore, should not be limited, except by the following claims and their equivalents.

What is claimed is:

1. A pen holder for wearing on a belt, comprising:

a front part;

a back part, attached to the front part, with a pocket formed between the front part and the back part;

a flap on the back part adapted to fold over at least a portion of the front part;

an attachment on the front part for securing the flap to the front part;

a pen in the pocket, with the pen fully enclosed by the pocket and the flap on all sides when the flap is secured to the front part;

a loop section attached to the back part for attaching the pen holder to a belt such that the pen is in a horizontal position relative to a user's body;

an attachment on the front part for securing the flap to the front part;

wherein the pocket has a closed end and an open end, and where the pen has a pen body including a tip, and a cap removable from the pen body, and with the tip of the pen engaged against the closed end, and with the flap covering and contacting the cap of the pen when the flap is secured to the front part.

2. The pen holder of claim 1 wherein the flap is adapted to hold the pen cap onto the pen body when the flap is secured to the front part.

3. The pen holder of claim 1 wherein the front part and the back part and the loop section comprise leather and are attached to each other via stitching.

4. The pen holder of claim 1 wherein the loop section and the back part form a loop opening between them, and the loop opening is substantially the same width of the belt of the user, so that the pen holder extends only nominally beyond the width of the belt.

5. The pen holder of claim 4 wherein the pen holder extends beyond the width of the belt only by twice the material thickness of the loop section.

6. The pen holder of claim 1 wherein the loop section, the front section, and the back section comprise flexible material.

7. The pen holder of claim 1 wherein the attachment comprises a member selected from the group consisting of hook and loop tape; buttons; snaps; magnetic attachments; belt loops; and mechanical fasteners.

8. The pen holder of claim 1 where the ratio of the length of the pen holder to the width of the pen holder ranges from 2 to 5.

9. The pen holder of claim 1 wherein the loop section is continuous.

10. The pen holder of claim 1 wherein the loop section comprises a plurality of individual belt loops.

11. The pen holder of claim 1 wherein the flap is integral with the back part.

12. The pen holder of claim 1 wherein the front part is the same length as the loop section.

13. The pen holder of claim 1 wherein the pen holder is less than 6 inches long, so that it can fit between the belt loops of the user's pants.

* * * * *